United States Patent [19]

Keilhau

[11] Patent Number: 5,036,765

[45] Date of Patent: Aug. 6, 1991

[54] ROTARY PRINTING MACHINE WITH WEB TEAR OR BREAKAGE DAMAGE CONTROL SYSTEM

[75] Inventor: Theo Keilhau, Neusäss, Fed. Rep. of Germany

[73] Assignee: MAN ROLAND Druckmaschinen AG, Offenbach am Main, Fed. Rep. of Germany

[21] Appl. No.: 496,456

[22] Filed: Mar. 20, 1990

[30] Foreign Application Priority Data

Apr. 1, 1989 [DE] Fed. Rep. of Germany ..... 3910556

[51] Int. Cl.[5] ..... B41F 1/08

[52] U.S. Cl. ..... 101/228; 101/219

[58] Field of Search ..... 101/219, 224, 225, 226, 101/227, 228, 232, 142, 143, 181; 226/11, 124

[56] References Cited

U.S. PATENT DOCUMENTS

| | | | |
|---|---|---|---|
| 4,508,033 | 3/1985 | Fischer | 101/228 |
| 4,549,485 | 10/1985 | Nawrath | 101/219 |
| 4,961,378 | 10/1990 | Balow et al. | 101/228 |

FOREIGN PATENT DOCUMENTS

| | | | |
|---|---|---|---|
| 2156506 | 11/1972 | Fed. Rep. of Germany . | |
| 2156505 | 2/1973 | Fed. Rep. of Germany . | |
| 2530365 | 1/1977 | Fed. Rep. of Germany . | |
| 133782 | 1/1979 | Fed. Rep. of Germany | 101/225 |
| 3215473 | 11/1983 | Fed. Rep. of Germany . | |
| 3431686 | 4/1986 | Fed. Rep. of Germany | 101/228 |
| 2317545 | 2/1977 | France . | |

*Primary Examiner*—Edgar S. Burr
*Assistant Examiner*—Joseph R. Keating
*Attorney, Agent, or Firm*—Frishauf, Holtz, Goodman, Woodward

[57] ABSTRACT

To capture a torn web traveling at high speed after receiving printed subject matter from a printing machine, the web is guided between a pair of capturing rollers (1, 55) which, in normal operation, pass the web without contact with the rollers therebetween. Upon sensing of a torn web, a "torn web" signal modifies the diameter of one of the rollers to engage against the other, with the torn web therebetween. This system eliminates moving the axes of rotation of the rollers. Expansion of the diameter of the expandable roller is achieved by forming the roller of part-cylindrical segments which are retained by pivot levers (9, 54) on a rotating spindle (13), the levers being movable under spring pressure (16) from a sharply inclined to a more erected position to thereby move the segments (2, 3, 4) outwardly. A sear (20, 21) releases spring pressure. Centrifugal force due to rotation of the rollers assists in rapid expansion of the effective diameter of the expandable roller.

12 Claims, 4 Drawing Sheets

ROTARY PRINTING MACHINE WITH WEB TEAR OR BREAKAGE DAMAGE CONTROL SYSTEM

FIELD OF THE INVENTION

The present invention relates to rotary printing machines, and more particularly to apparatus to prevent damage to the printing machine if a web traveling through the printing machine, for example a paper web, should tear; such tears may cause wrap-around of the web about a cylinder involved in the printing process.

BACKGROUND

German Patent 21,56,506 describes a monitoring system to detect if a web in a printing machine should tear. Such web breaks or web tears may cause substantial damage in the printing stations due to wrap-around of the torn sheet about a cylinder. This is particularly dangerous with respect to the last printing station located in advance of a dryer or the like. If the web should tear at that point, the torn end of the web may be pulled into the preceding printing station and wrap around a cylinder and, if the machine is an offset printing machine, would usually wrap around the blanket cylinder. This increases the effective diameter of the blanket cylinder and causes damage in the printing station.

The referenced patent also describes an arrangement in which, when a web break is sensed, two rollers or cylinders, termed "paper capturing rollers", can be moved towards each other. In normal operation, the paper web is guided without contact between these two rollers. When a break is sensed, the rollers are moved towards each other so that the torn web can wrap around one of the capturing rollers which, however, is resiliently journalled so that increase in its diameter will not cause damage. Preferably, such capturing rollers are located in advance of the dryer. It is customary to journal one of the rollers in a fixed position, whereas the other one is movable. The two rollers are elastically engaged against each other, thus permitting roll-up of a torn or broken web on one or both of the rollers without leading to damage, since one of the rollers at least can resiliently radially deflect. Even if the paper does not wrap itself about one or both of the capturing rollers, the capturing rollers prevent that the torn web is pulled back into the last one, or any one of the preceding printing stations and cause damage therein.

The arrangement, as proposed, has a disadvantage, namely that with increasing operating speed of rotary printing machines, the time available to capture the broken or torn web becomes less and less. Due to the mass of the capturing rollers, criteria involving stability of the system limit the speed with which the rollers can be moved against each other. The spring force in known apparatus, which also in part determines the capturing speed or capturing time, cannot be increased beyond certain limits.

THE INVENTION

It is an object to provide a paper web damage control system, utilizing the well known concept of capturing rollers, which is so constructed that the triggering speed, upon sensing a break to capture the torn or broken web, is increased and, further, which is preferably so constructed that centrifugal forces arising in the operation of the system support the speed of capturing a broken web.

Briefly, at least one of the capturing rollers of a roller pair is constructed in form of a hollow sleeve, in which the sleeve is subdivided into a plurality of outwardly movable part-cylindrical sleeve segments, which are retained on a rotating shaft element, such that the radial spacing of the segments from the center of rotation can change. Upon sensing of a tear, the segments are rapidly moved outwardly, thus increasing the effective diameter of that roller and bring this roller into engagement with its counter capturing roller of the pair, with the torn web therebetween, to rapidly pinch the web between the rollers, and thus capture the torn web.

The arrangement has the substantial advantage that the speed of response to engage the two rollers of the pair against each other is substantially increased, and, at the same time, permit a substantial increase in the resilient spring force which presses the rollers against each other, with the web therebetween. Since both rollers, under normal operation, are rotating at circumferential speeds which at least approximately are the same as the linear speed of the web traveling therebetween, the centrifugal force acting on the segments assists the radial spreading of the circumference of the roller which has the segmental outer circumference.

DRAWINGS

DETAILED DESCRIPTION

The present invention utilizes, as well known in the field of paper web handling in printing machines, two capturing rollers. One can be located to rotate about a fixed axis; the other rotatable capturing roller can be elastically, preferably under spring force, surface-engaged with the first roller. In normal operation, the paper web 57 (FIG. 1) is passed between the surface of one roller 55, and the surface of a second roller 1, which has sleeve or surface segments 2. Upon sensing of a tear, a "torn web" signal is generated, so that, when this signal is received by the roller which can come in engagement with the web 57, its surface is moved in surface engagement with the roller 55, with the paper web 57 therebetween.

In accordance with the present invention, and in a departure from the prior art, the position of the axis of rotation of the capturing roller 1 is not changed but, rather, its diameter is changed.

Figure 1:
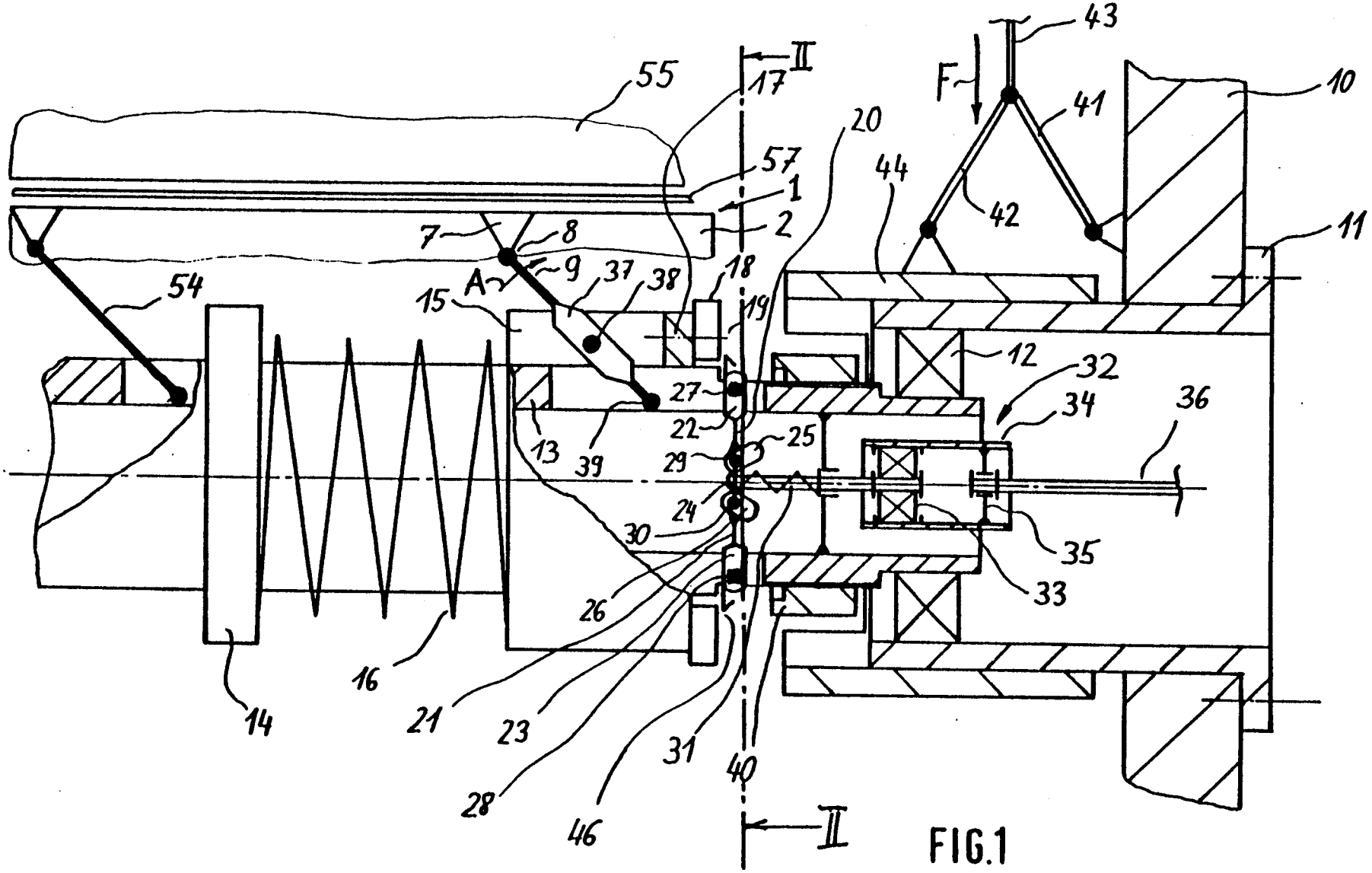
FIG. 1 is a side view, partly in section, of a control system for a capturing roller.
Figure 2:
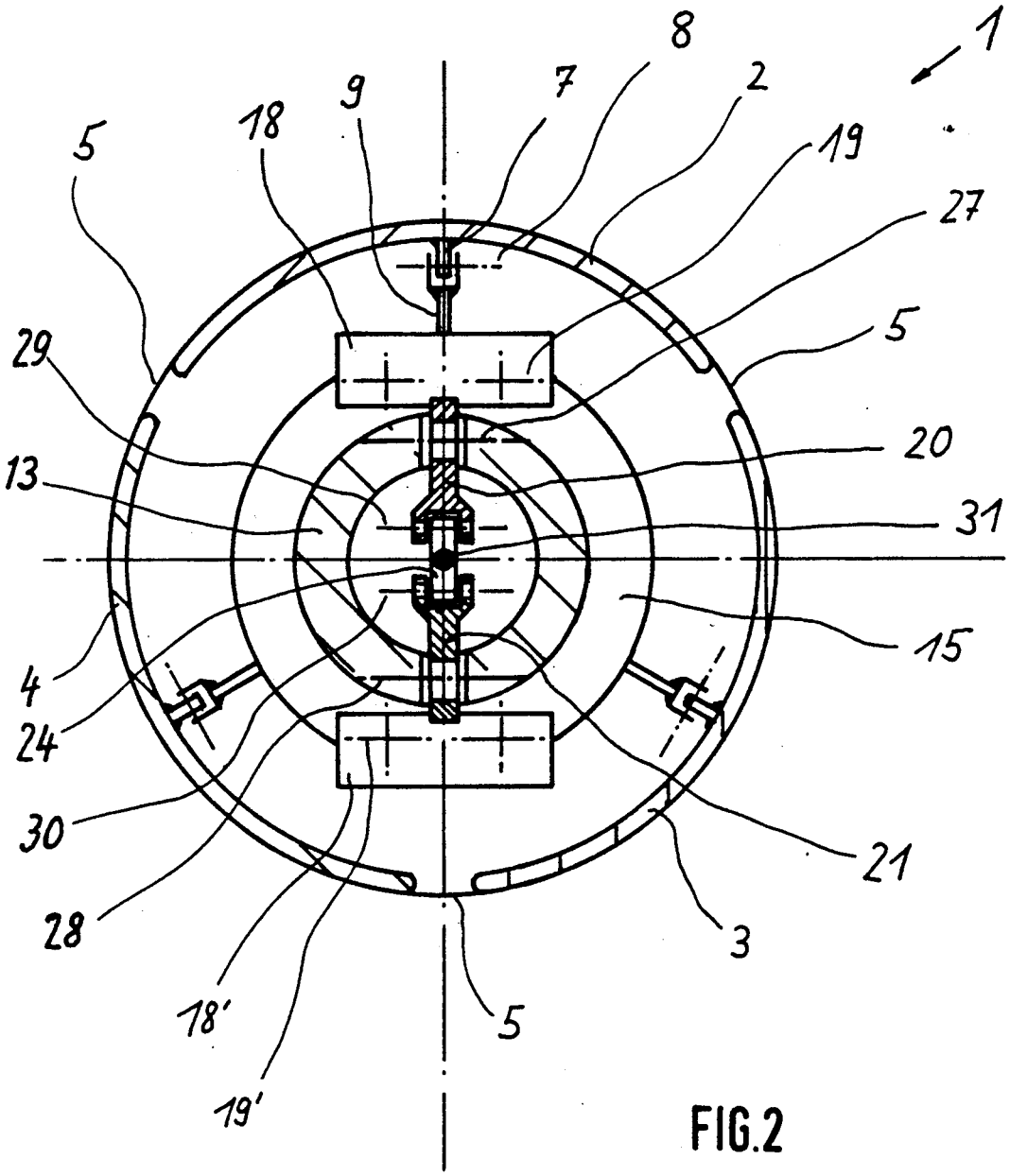
FIG. 2 is a cross section along line II—II of FIG. 1.

The present invention, thus, essentially is directed to changing the diameter of at least one of the capturing rollers 1. FIGS. 1 and 2, thus, only show the mechanism which changes the diameter of the respective roller. Both of the capturing rollers 1 and 55 are located between side walls of the printing machine, of which only one is shown in fragmentary form, highly schematically, at 10; of course, a separate frame may be provided.

Suitable sensing apparatus to sense a torn web are known, and reference to this state of technology is made, for example, in German Patent 21,56,506. Such tear sensing apparatus may be based on spring-loaded rollers, optical apparatus, or the like. Basically, however, the web monitoring apparatus provides a control signal which controls the capturing of the web in advance of the tear. Electromagnets or other force generating apparatus such as pneumatic or hydraulic cylinders may be used, triggered into capturing position by a "torn web" signal.

At least one of the capturing rollers, as illustrated in the present application, roller 1, is supplied with apparatus to increase its diameter. This apparatus is shown at the right portion of the roller 1, partly in section.

Figure 3:
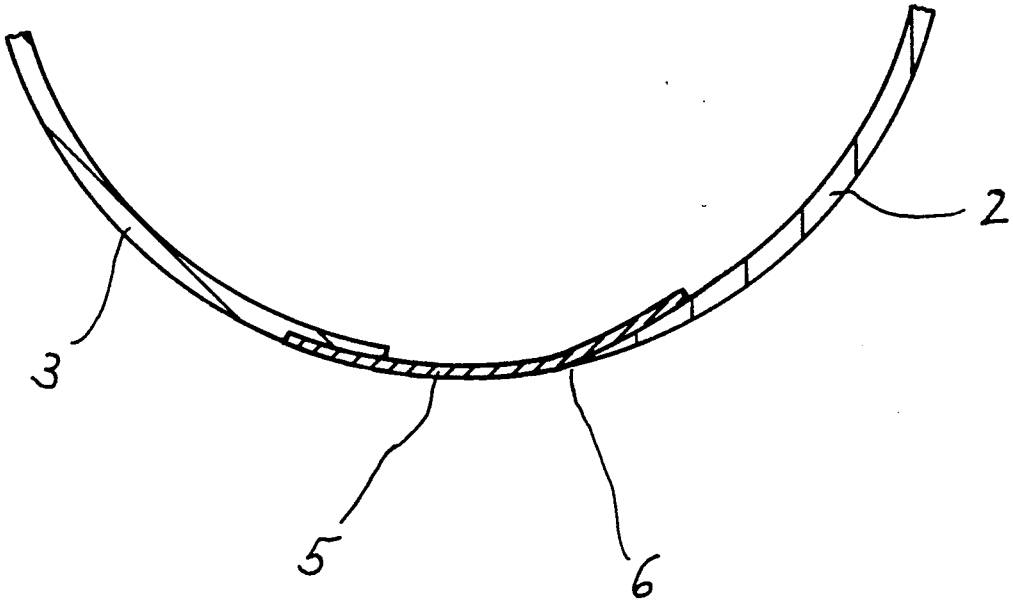
FIG. 3 is a fragmentary cross section through a portion of two adjacent sleeve or jacket segments and the connection thereof.

In accordance with a feature of the invention, the roller 1 has a jacket or sleeve formed of a plurality of part-cylindrical segments. Preferably, three sleeve segments 2, 3, 4 (FIG. 2) are used. These segments, as seen in FIG. 3, are connected together by an elastic bridge element 5, which may be made of spring steel or the like. Preferably, bridge element 5 is so connected to two ends of adjacent segments, as shown the segments 2 and 3, that in general a smooth outer sleeve surface is provided, without any ridges or abutments, which may lead to additional tearing of the paper web to be captured, and which might additionally interfere with operation of the paper capturing system. A smooth transition, particularly as shown at 6 in FIG. 3, is preferred, in which the segment 2 tapers to a thin line, smoothly merging with the bridge element 5. The other end of bridge element 5 can be secured in any suitable manner to the next adjacent segment 3.

The segments 2, 3, 4 are secured by suitable bearing blocks 7, on which pivot levers 9 are secured by bolts 8 (see FIGS. 1 and 2). As best seen in FIG. 1, a plurality of such levers 9 are used along the length of the roller segments 2, 3, 4, to provide for stable retention and guidance of the segments, see lever 54.

The right portion of the roller 1, see FIG. 1, is journalled in a side wall of the machine, or in a frame 10, by means of a bearing bushing 11, within which a bearing 12 is located. A spindle 13 is retained in the bearing 12, rotating with the segments 2, 3, 4. The other end of the spindle 13 is positioned in the opposite side wall of the printing machine, not shown, or in a separate frame provided for the capturing roller pair.

The rotating spindle 13 has a ring 14 located thereon, fixed thereto and rotating therewith, and axially spaced therefrom an axially slidable ring 15. A spring 16 is located between the rings 14, 15 which, under normal printing operation, is compressed. The ring 15 is blocked and retained in its left-most position. Hence, under normal operation, the spring 16 is stressed.

The screw 19, engaging a tap bore 17, retains a radially positionable block 18. As seen in FIG. 1, a similar block is located diametrically opposite at the other side of the spindle 13, likewise radially positionable. The opposite block and screw connection has been given the same reference numeral with prime notation, see FIG. 2, that is, blocks 18' and screw 19'. By adjustment of the blocks and tightening of the screws 19, the engagement range of at least one, and preferably two oppositely located sears 20, 21, is set. Sears 20, 21 have inclined end portions terminating in sear edges 46, and hold the blocks 18, 18', and hence the axially slidable ring 15, in normal operation, in the position shown in FIG. 1, in which the spring 16 is compressed and stressed.

The two sears 20, 21 are formed with radially directed elongated holes 22, 23 and further elongated holes 25, 26 extending in an inclined position. An axially shiftable connecting plate 24 permits shifting the sears 20, 21 in radial direction. The plate 24 has bolts 29, 30 which engage in the inclined holes 25, 26. Bolts 27, 28 are located on the spindle 13 and pass through the sears 20, 21, as best seen in FIG. 2. Bolts 27, 28 do not pass through the plate 24 but, rather, merely form connecting elements, for longitudinal guidance of the sears 20, 21 on the spindle 13.

The arrangement provides for radial control of the sears 20, 21 so that, upon axial shifting of a spring-loaded control bolt 31, the ring 15 seated on the spindle 13 can be released and moved in axial direction at high speed.

The control bolt 31 rotates with the roller 1 and is coupled via a bearing 33 located in a bushing 34 with a pin 35 which passes through or is coupled to an armature 36 of an electromagnet, a piston of a hydraulic system, a pneumatic cylinder, or the like. The electromagnet, pneumatic or hydraulic cylinder, forms the operating element which is activated upon sensing of a web tear or break, with the result that the element 36 moves axially. The coupling 32 which includes the bushing 34 and the bearing 33 as well as pin 35 provides for transferring the triggering force in dependence on a "web tear" signal to the plate 24.

OPERATION

Let it be assumed that, initially and under normal operation, the cylinder 1 with the segments 2, 3, 4 rotates and a web 57 passes contactless and freely in the gap between the outer circumference of the segments and the outer circumference of a roller 55 which rotates about a fixed axis of rotation.

When a monitoring or sensing apparatus provides a "torn web" signal, operation of the element 36 via the plate 24 causes the bolts 29, 30 to engage the sears 20, 21 and draw them inwardly. This releases the spring-loaded ring 15, and causes deflection, axially to the left, of bolts 38 which engage in elongated openings 37 of the levers 9. This deflects the levers 9, since the lower ends of the levers 9 are retained by suitable bolts 39 on the spindle 13, while permitting pivoting of the levers 9 in the direction of the arrow A. This causes the segments to be moved outwardly. The spring 16, thus, presses the lever 9 in the direction of the arrow A to move, in FIG. 1, the segment 2 upwardly upon shifting of the ring 15. This presses the sleeve segment 2 radially outwardly, extending the diameter of the roller 1 and pinching the torn end of the web 57 between the rotating segments of the cylinder 1 and the counter roller 55 of the capturing roller pair.

Each one of the segments 2, 3, 4 are supplied with the apparatus shown in FIGS. 1 and 2, as schematically indicated in FIG. 2. Each one of the segments has at least two such levers 9, as seen at 54 in FIG. 1, when looked at in axial direction.

Reset of the axially shiftable ring 15 in the normal position, in which the spring 16 is compressed, is carried out by the apparatus portion shown at the right side in FIG. 1. A stop 40 is provided which, also upon capturing, forms a stop or abutment when the ring 15 travels towards the right under force of the spring 16, since the blocks 18 run up against the abutment 40.

After a tear has been sensed, and the defect in the printing operation removed, so that, after removal of wrapped-around web material about rollers 1, 55, or both, the printing machine can again be started, it is necessary to provide clearance space between the circumferences of rollers 1 and 55, which requires compression of the ring 15 towards the left, against the force of spring 16 (FIG. 1). Since spring 16 can be selected to be a very strong spring, a leverage system is provided, shown, in FIG. 1, by a double-armed lever 41, 42 which is centrally pivoted and can be stretched by applying a downward force in the direction of the arrow F on a link 43 acting on a pivot between the lever sections 41, 42. A reset bushing 44, coupled to the lever 42, is thereby moved towards the left (FIG. 1), which bushing 44 engages the blocks 18, 18' and shifts them towards the left against the pressure of the spring 16. The ring 15 can run over the inclined surfaces of the sears 20, 21 in the position shown in FIG. 1, so that the sears 20, 21 can then hold the ring 15 counter the stressed force of the compression spring 16. The abutment 40 is fixed. Bushing 44 runs over the abutment 40 and only engages blocks 18.

Figure 4:
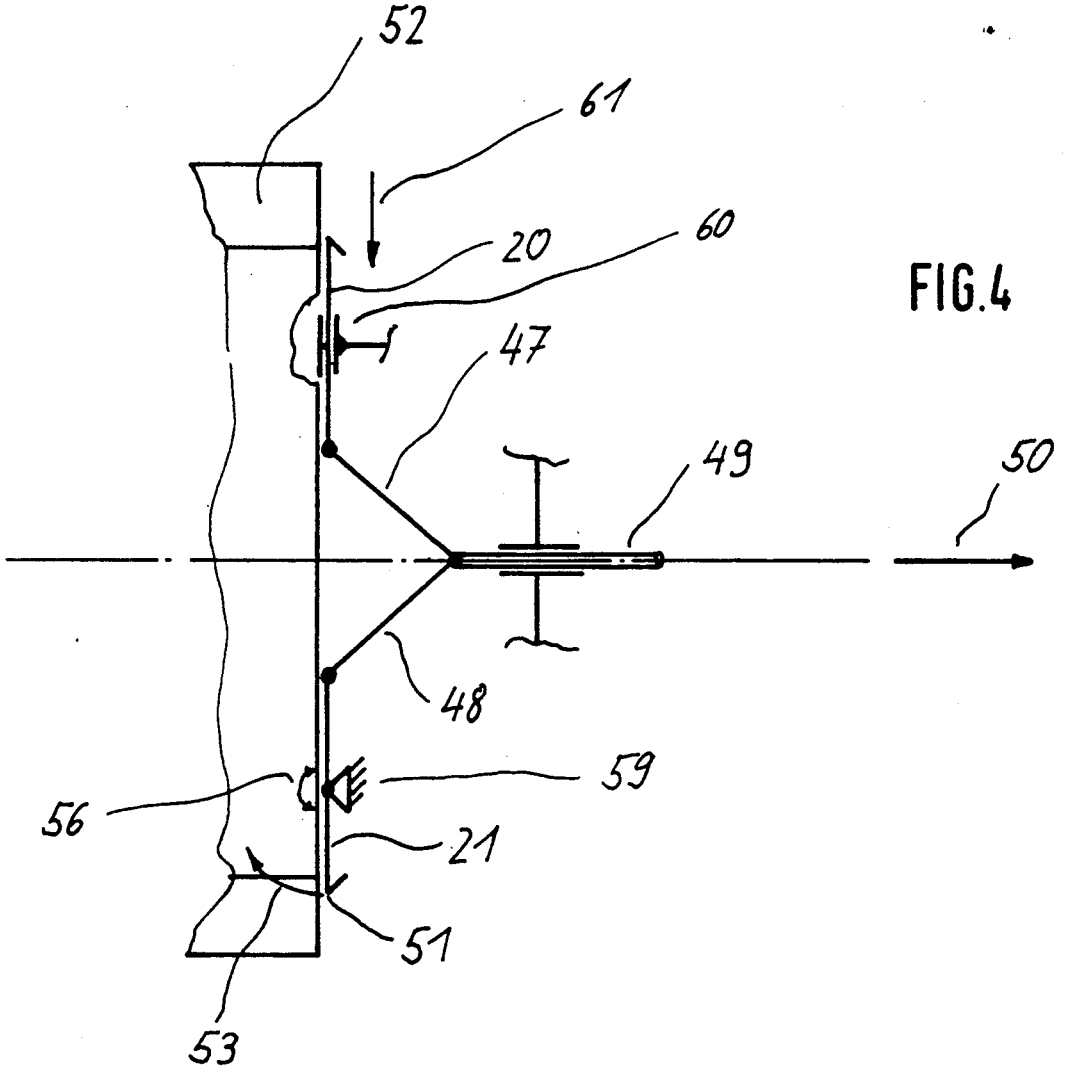
FIG. 4 shows an arrangement to control release and reset of circumferential segments.

The sears 20, 21 can be shifted outwardly in various ways; FIG. 4 illustrates an arrangement in which the sear 20 is shifted differently from the sear 21; for most operations, the systems can be symmetrical, but they need not be.

Sears 20, 21 are moved by two levers 47, 48 which move, in scissor arrangement, towards and away from each other. To shift the sears 20, 21, a piston or operating rod is shifted in the direction of the arrow 50 (FIG. 4), which causes the sears 20, 21 to be pulled together, that is, radially inwardly. The arrangement shifting sear 21 provides for pivoting of the link 21 about a fixed bearing 59, as shown by arrow 56. Upon radial withdrawal of the sears 20, 21, the tips 51 of the sears release an axially shiftable ring 52, which is a schematic representation of ring 15 (FIGS. 1, 2) and has the effect of the ring 15. This is a very simple control mechanism which, however, causes a force in the direction of the arrow 53 to occur, which is a frictional force between the tip 51 of the sear and the ring 52, and which must be overcome.

Sear 20 uses a somewhat more complex arrangement for radial shifting, by using a slide bearing 60, replacing the pivot bearing 59. Thus, the links move as shown by the arrow 61, and the frictional forces which arise with respect to link 21 are eliminated.

In a preferred arrangement, both sears 20, 21 have similar release and reset arrangements, although the simplified arrangement with respect to sear 21, used only on one side, may not introduce so much friction that the entire mechanism, with the more complex system with slide bearings 60 combined therewith, results in difficult operation.

Various changes and modifications may be made, since many different arrangements are possible to trigger or release a stretching mechanism upon being triggered by a release signal. Basically, however, the increase in diameter by radial movement of a plurality of segments 2, 3, 4 increases the diameter of at least one of the capturing rollers, here roller 1, of a roller pair, so that the axial position of both of the capturing rollers, that is, roller 55 and roller 1, can remain fixed. In ordinary operation, a gap between the surfaces of rollers 1, 55 is provided to lead the web 57 therebetween, which gap is eliminated by increasing the operating diameter of the roller 1 and pinching the web 57 therebetween so that a torn web will be captured and can then wrap itself about one of the rollers 1 or 55, or at least be separated from the printing station to be protected, so that wrapping of the torn web about a printing machine roller is effectively prevented.

Since only the outer jacket or sleeve portions of the capturing roller, the diameter of which is to be increased, has to move and that movement is assisted by centrifugal force—the capturing rollers rotating—the speed of effective response upon receiving a triggering signal can be substantially increased over rollers which have to be shifted radially in their entirety, drive shaft and all.

I claim:

1. In combination with a rotary printing machine, a moving web breakage or tear damage control system, to prevent damage to the printing machine upon tearing or breakage of a web (57) passing through the printing machine, said system having a roller pair (1, 55) comprising normally spaced rotary rollers to permit contactless passage of the web therebetween, at least one (1) of said rollers of the pair being surface-engageable against the other (55) upon detection of a tear or break in the web, said system comprising, in accordance with the invention, an arrangement to increase the diameter of said at least one roller (1) to thereby engage the web (57) against the other roller (55), wherein said at least one roller comprises a sleeve structure formed of a plurality of partly cylindrical sleeve segments (2, 3, 4);

and means (7–9) for radially spreading outwardly said sleeve segments of said at least one roller (1) for engagement with the other roller (55), with the torn web therebetween, to thereby pinch the web between the rollers.

2. The system of claim 1, wherein said spreading means (7, 9) comprises at least one lever (9) pivotably coupled at one end with an associated segment (2), and pivotably coupled at the other end with a rotating spindle (13), said lever being formed with an elongated opening (37) therethrough;

and an engagement bolt (38);

and spring means (16) operatively coupled to said engagement bolt and, upon occurrence of a web break, moving said bolt within said elongated opening in a direction to move said lever (9) radially outwardly to thereby radially outwardly move the associated part-cylindrical segment.

3. The system of claim 2, further including a fixed abutment means (14) located on said rotating spindle (13), an axially slidable ring (15) surrounding said spindle (13), and a spring (16) positioned between said abutment means and said axially slidable spindle;

and sear means (20, 21) retaining said axially slidable ring on the spindle, with the spring (16) therebetween in stressed condition, said sear means being releasable such that the ring (15) can be shifted axially by the spring means;

and wherein the engagement bolts (38) are coupled to the slidable ring (15) to change the angular position of the lever (9) with respect to the axis of rotation of the spindle and extend the levers radially to thereby spread outwardly said part-cylindrical segment to which it is coupled.

4. The system of claim 3, wherein said sear means (20, 21) includes radially adjustable blocks (18) and sear elements (20, 21) positionable in interfering, and clearing position with respect to said blocks, said sear elements being formed with guide means (22, 23; 27, 28) guiding the sear elements on said rotating spindle (13), said sear elements further including inclined openings (25, 26) thereon;

a coupling plate (24) including projecting bolts (29, 30) engaging in said inclined openings, and, upon axial shifting of said coupling plate, moving said sear elements from interfering position with respect to said blocks to a clearing position to thereby release said axially slidable ring and permit the spring (16) to push the ring (15) axially and hence pivot the levers (9) and expand the diameter of said one roller.

5. The system of claim 4, further including an axially movable control element (31) coupled to said coupling plate (24);

said axially movable control element (31) axially moving the coupling plate upon detection of a web tear or web break.

6. The system of claim 5, further comprising an axially moving, rotary-stationary coupling means (32) coupled to said control element (31);

and axially movable operating means (36) coupled to said axially movable rotary-stationary coupling means, said axially movable operating means causing axial movement which axially moves said control element (31).

7. The system of claim 4, further comprising an abutment or stop element (40) located in fixed position with respect to said spindle (13) and axially limiting movement of at least one of: said control element (31), said axially slidable ring (15).

8. The system of claim 7, further including a bearing (12) positioned within a bearing bushing (11) and rotatably retaining said spindle (13) therein;

a reset bushing (44) located on said bearing bushing (11);

a two-element lever (41, 42) coupled, at one end, to a fixed position and, at the other, to said reset bushing (44), said reset bushing being movable, upon spreading said two-arm lever, in a direction for engagement with said axially slidable ring counter the force of said spring (16).

9. The system of claim 1, further including bridging means (5) circumferentially coupling said segments (2, 3, 4) while permitting radial movement of adjacent segments relative to each other, said bridging means coupling said segments and forming, with adjacent segments, an essentially smooth continuous circumferential surface.

10. The system of claim 3, further including sear reset means (47, 48) engageable with said sear means, said sear reset means comprising a scissor lever arrangement (47, 48) for radially spreading the sear means.

11. A method of capturing a torn web comprising the steps of:

providing a pair of spaced capturing rollers;

passing a web in a contactless manner between the surfaces of said capturing rollers;

sensing a web tear; and responsive to said sensing of a web tear, expanding the diameter of at least one of said capturing rollers to engage the other of said capturing rollers, thereby pinching the web between said rollers.

12. The method of claim 11, wherein said step of expanding the diameter of said at least one capturing roller (1) comprises forming said capturing roller with a plurality of part-cylindrical segmental surface portions (2, 3, 4); and for expansion of the diameter of said at least one capturing roller, moving said part-cylindrical segmental portions outwardly until they engage the other capturing roller (55) of the pair, with the web (57) pinched therebetween.

* * * * *